US009039449B2

(12) United States Patent
Zerebilov et al.

(10) Patent No.: US 9,039,449 B2
(45) Date of Patent: May 26, 2015

(54) STAGGERED MOUNTING ELECTRICAL CONNECTOR

(71) Applicants: Arkady Y. Zerebilov, Lancaster, PA (US); Steven E. Minich, York, PA (US)

(72) Inventors: Arkady Y. Zerebilov, Lancaster, PA (US); Steven E. Minich, York, PA (US)

(73) Assignee: FCI AMERICAS TECHNOLOGY LLC, Carson City, NV (US)

( * ) Notice: Subject to any disclaimer, the term of this patent is extended or adjusted under 35 U.S.C. 154(b) by 212 days.

(21) Appl. No.: 13/644,393

(22) Filed: Oct. 4, 2012

(65) Prior Publication Data

US 2013/0084744 A1 Apr. 4, 2013

Related U.S. Application Data

(60) Provisional application No. 61/543,053, filed on Oct. 4, 2011.

(51) Int. Cl.

*H01R 13/648* (2006.01)
*H01R 12/70* (2011.01)
*H01R 13/6594* (2011.01)

(52) U.S. Cl.

CPC ..... *H01R 12/7052* (2013.01); *H01R 13/6594* (2013.01); *Y10T 29/49208* (2015.01)

(58) Field of Classification Search

USPC ..... 439/607.35, 0.39, 0.42, 0.53, 0.55, 0.01
See application file for complete search history.

(56) References Cited

U.S. PATENT DOCUMENTS

| | | | | |
|---|---|---|---|---|
| 5,030,140 | A * | 7/1991 | Sugiyama | 439/607.35 |
| 6,386,918 | B1 * | 5/2002 | Zheng et al. | 439/607.45 |
| 6,478,623 | B1 * | 11/2002 | Wu | 439/607.35 |
| 6,517,382 | B2 | 2/2003 | Flickinger et al. | |
| 6,533,470 | B2 | 3/2003 | Ahrens | |
| 6,540,412 | B2 | 4/2003 | Yonemura et al. | |
| 6,655,995 | B1 | 12/2003 | Reisinger et al. | |
| 7,179,124 | B2 * | 2/2007 | Zhang et al. | 439/607.55 |
| 7,371,965 | B2 | 5/2008 | Ice | |
| 7,967,639 | B1 * | 6/2011 | Huang et al. | 439/607.35 |
| 8,021,188 | B1 * | 9/2011 | Ma et al. | 439/607.55 |

OTHER PUBLICATIONS

"Supplement to InfiniBand™, Annex A6: 120Gb/s 12x Small Form-Factor Pluggable (CXP): Interface Specification for Cables, Active Cables, & Transceivers", InfiniBand$^{SM}$ Trade Association, Sep. 2009, 94 pages.

* cited by examiner

*Primary Examiner* — Hien Vu
(74) *Attorney, Agent, or Firm* — Baker & Hostetler LLP

(57) ABSTRACT

A staggered mounting electrical connector assembly can include a shroud and an electrical connector. The electrical connector can include a connector housing, and the shroud can be configured to be mounted to the connector housing in a staggered fashion. The shroud and the connector housing can include complementary alignment members configured to interface with each other. The alignment members can act to align mounting members defined by the shroud during the process of mounting the shroud and the connector housing to an underlying substrate, such as a printed circuit board.

24 Claims, 8 Drawing Sheets

STAGGERED MOUNTING ELECTRICAL CONNECTOR

CROSS-REFERENCE TO RELATED APPLICATIONS

This application claims the benefit of U.S. Provisional Application No. 61/543,053 filed Oct. 4, 2011, the disclosure of which is hereby incorporated by reference as if set forth in its entirety herein.

BACKGROUND

Electrical connectors provide signal connections between electronic devices using electrically-conductive contacts, or electrical contacts. In some applications, an electrical connector provides a connectable interface between one or more substrates, e.g., printed circuit boards. The components of such an electrical connector may include a connector housing configured to carry a plurality of electrical contacts and to be mounted to the printed circuit board, and a shroud configured to at least partially enclose the connector housing and/or the electrical contacts, and to be mounted onto the connector housing and to the printed circuit board. Typically, both the connector housing and the shroud have respective mounting members that must be aligned with corresponding mounting apertures on the printed circuit board when the components are mounted onto the printed circuit board. Because each component has mounting members that require alignment, typically mounting the components of the electrical connector requires two separate alignment and mounting procedures.

SUMMARY

In accordance with an embodiment, an electrical connector assembly that is configured to be mounted onto an underlying substrate along a mounting direction includes an electrical connector and an electrically conductive shroud. The electrical connector includes a connector housing and at least one electrical contact carried by the connector housing. The shroud can be mounted on the connector housing in a partially mounted position relative to the connector housing, such that the shroud is attached to the connector housing and the connector housing extends further in the mounting direction than the shroud when the shroud is in the partially mounted position. The electrical contact includes at least one mounting tail configured to be mounted to the underlying substrate and a mating end configured to be electrically mated to a complementary electrical component. The connector housing includes at least one first alignment member having an initial thickness along a select direction. The electrically conductive shroud can be configured to fit over the connector housing. The shroud includes a mounting member configured to be received in a complementary aperture of the underlying substrate and at least one second alignment member having an initial thickness along the select direction. When the shroud is mounted onto the connector housing so that the mounting member is aligned with the complementary aperture, one of the first and second alignment members is configured to be received by the other. The received alignment member is compressed by the other alignment member so that the thickness of the received alignment member decreases to be no greater than the thickness of the other alignment member.

In accordance with another embodiment, an electrical connector assembly is configured to be mounted to an underlying substrate along a mounting direction. The electrical connector assembly includes an electrical connector and an electrically conductive shroud. The electrical connector includes a dielectric connector housing and a plurality of electrical contacts carried by the connector housing. The connector housing presents a lower exterior surface that defines a mounting interface configured to be mounted onto the underlying substrate and an upper exterior surface that is opposite the lower exterior surface. Each electrical contact defines a mating end and a mounting tail. Each mounting tail is disposed proximate to the mounting interface and terminates at a location that is spaced from the upper exterior surface a first distance along the mounting direction. The electrically conductive shroud can be configured to be mounted onto the connector housing in a first position relative to the connector housing and a second position that is offset with respect to the first position in the mounting direction. The electrically conductive shroud can include at least one mounting member that is configured to be received in a complementary aperture of the underlying substrate when the shroud is in the second position. When the shroud is mounted onto the connector housing in the first position, the mounting member terminates at a location that is spaced from the upper exterior surface of the connector housing a second distance that is shorter than the first distance. Further, the shroud and the connector housing define a mechanical interference that resists movement of the shroud along the connector housing from the first position to the second position, such that when a force is applied to the shroud that overcomes the mechanical interference, the shroud moves from the first position toward the second position, thereby moving the mounting member toward the complementary aperture.

BRIEF DESCRIPTION OF THE DRAWINGS

The foregoing summary, as well as the following detailed description of example embodiments of the application, will be better understood when read in conjunction with the appended drawings. For the purposes of illustrating the staggered mounting electrical connector, there are shown in the drawings example embodiments. It should be understood, however, that the instant application is not limited to the precise arrangements and/or instrumentalities illustrated in the drawings, in which.

DETAILED DESCRIPTION

Figure 1:
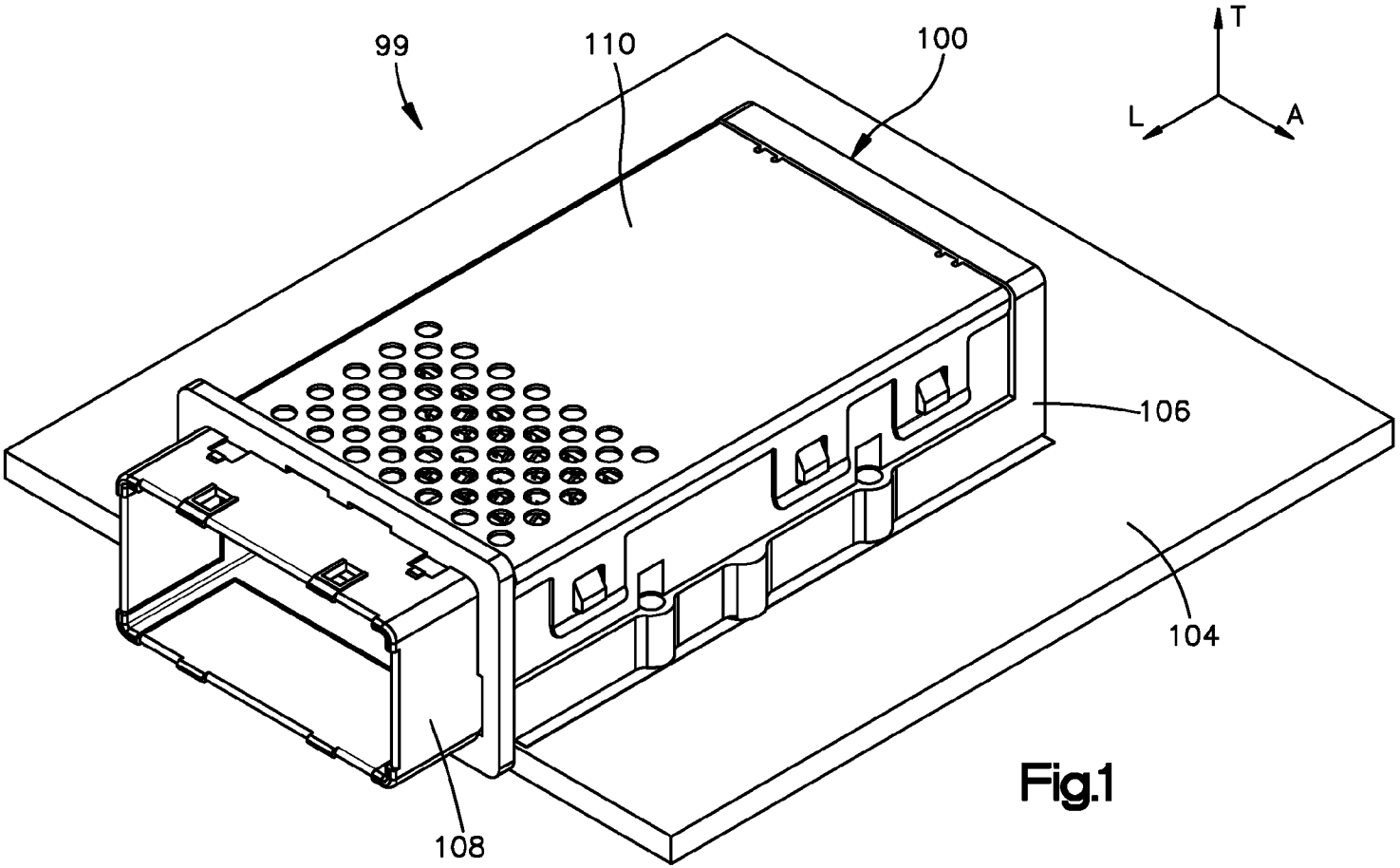
FIG. 1 is a perspective view of an electrical connector system in accordance with one embodiment including an electrical connector assembly, which in turn includes an electrical connector and a shroud, and an underlying substrate, whereby the electrical connector assembly is shown mounted to the underlying substrate.

For convenience, the same or equivalent elements in the various embodiments illustrated in the drawings have been identified with the same reference numerals. Certain terminology is used in the following description for convenience only and is not limiting. The words "left," "right," "front," "rear," "upper," and "lower" designate directions in the drawings to which reference is made. The words "forward," "forwardly," "rearward," "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 2:
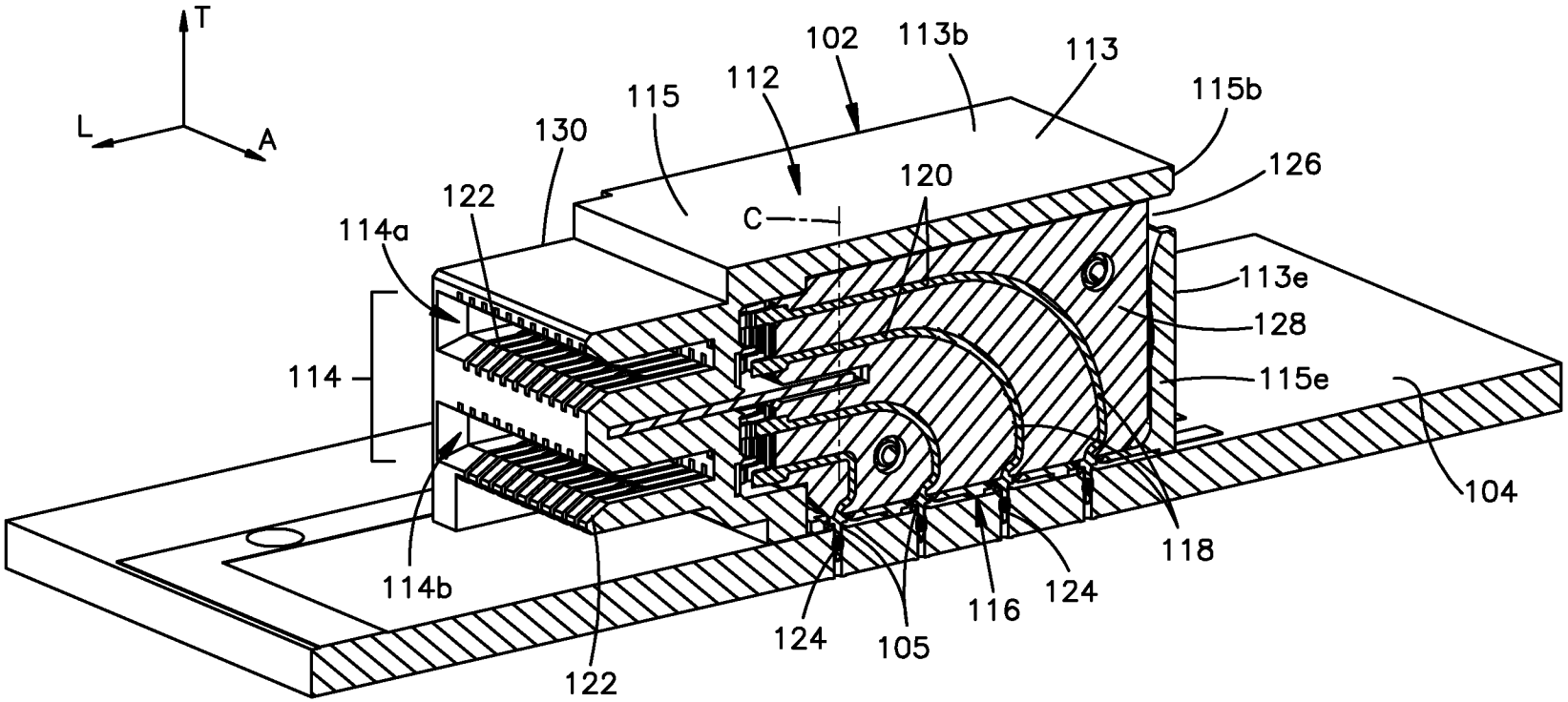
FIG. 2 is a cross-sectional perspective view of the electrical connector system illustrated in FIG. 1, showing the shroud removed.
Figure 3:
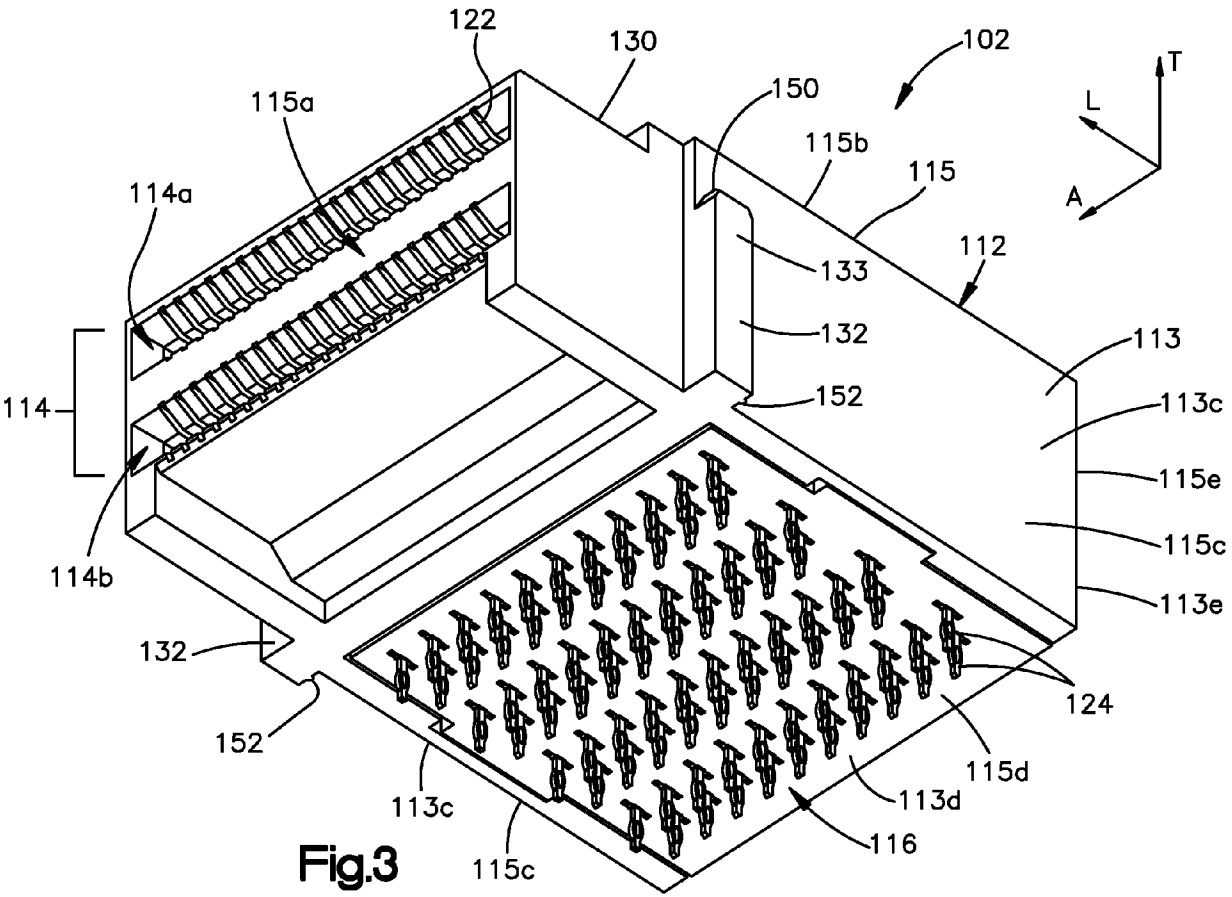
FIG. 3 is a perspective view of the electrical connector illustrated in FIG. 1.

Referring initially to FIGS. 1-3, in accordance with one embodiment, an electrical connector system 99 can include an electrical connector assembly 100 and a substrate, such as a printed circuit board 104, such that the electrical connector assembly 100 is configured to be mounted to the printed circuit board 104. The electrical connector assembly 100 can include an electrical connector 102 and an electrically conductive shroud 106 that is configured to at least partially surround the electrical connector 102. Both the electrically conductive shroud 106 and the electrical connector 102 are configured to be mounted to the printed circuit board 104 so as to mount the electrical connector assembly 100 to the printed circuit board 104.

The electrical connector 102 can include a dielectric or electrically insulative connector housing 112 and a plurality of electrical contacts 118 that are supported by the connector housing 112. When the electrical connector 102 is mounted to the printed circuit board 104 along a mounting direction, the electrical contacts 118 are placed in electrical communication with electrical traces of the printed circuit board 104. The electrically conductive shroud 106 can be configured to fit over the connector housing 112, and translate along the connector housing 112 along the mounting direction, so as to be mounted onto the printed circuit board 104. The electrical connector system 99 can further include a complimentary electrical connector configured to mate with the electrical connector 102 so as to establish an electrical connection between the electrical contacts 118 of the electrical connector 102 and complementary electrical contacts of the complementary electrical connector, and thus also to an electrical component to which the complementary electrical connector is mounted. For instance, the electrical component to which that the complementary electrical connector is mounted can be an underlying substrate such as a printed circuit board or any other suitable electrical device.

In accordance with the illustrated embodiment, the electrical connector 102 can be constructed as a card-edge connector, such as a CXP card-edge connector in accordance with the "Supplement to InfiniBand™ Architecture Specification Volume 2 Release 1.2.1" Annex A6: 120 Gb/s 12× Small Form-factor Pluggable (CXP), Interface Specification for Cables, Active Cables, & Transceivers, InfiniBand$^{SM}$ Trade Association (September 2009), the disclosure of which is incorporated herein by reference in its entirety. It should be appreciated, however, that the electrical connector 102 can be alternatively constructed in any suitable manner as desired.

The electrical connector 102 can be constructed as a right-angle connector that defines a mating interface 114 and a mounting interface 116 that extends substantially perpendicular to the mating interface 114. The mating interface 114 can be configured to mate with a complementary mating interface of a complementary electrical connector that is to be mated to the electrical connector 102. The mounting interface 116 is configured to be mounted onto an underlying substrate, such as the printed circuit board 104. The mating interface 114 can include first and second receptacle pockets 114*a* and 114*b*, respectively, wherein the first receptacle pocket 114*a* can be positioned as an upper receptacle pocket and the second receptacle pocket 114*b* can be positioned as a lower receptacle pocket.

Referring to FIG. 2, the electrical connector 102 can include a plurality of leadframe assemblies 126 supported by the connector housing 112. Each of the leadframe assemblies 126 can include a dielectric or electrically insulative leadframe housing 128 that carries a respective plurality of the electrical contacts 118. Thus, it can be said that the electrical contacts 118 are carried by the connector housing 112. The leadframe assemblies 126 can be configured as insert molded leadframe assemblies (IMLAs) whereby the leadframe housing 128 is overmolded onto the respective plurality of electrical contacts 118. Alternatively, the electrical contacts 118 can be stitched into the leadframe housing 128 or otherwise supported by the leadframe housing 128.

Various structures are described herein as extending horizontally along a longitudinal direction "L" and a lateral direction "A" that is substantially perpendicular to the longitudinal direction L, and vertically along a transverse direction "T" that is substantially perpendicular to the longitudinal and lateral directions L and A, respectively. As illustrated, the transverse direction "T" extends along a vertical direction, and defines a mounting direction M along which one or both of the electrical connector 102 and printed circuit board 104 are moved relative to the other so as to mount the electrical connector assembly 100, including the electrical connector 102 and the shroud 106, to the printed circuit board 104. Similarly, one or both of the connector housing 112 and the shroud 106 can be moved relative to the other along the mounting direction M so as to attach the shroud 106 to the connector housing 112 (see FIG. 6). For instance, the mounting direction M of the electrical connector 102 can be a downward direction along the transverse direction T. The lateral direction "A" extends along a width of the electrical connector 102. As illustrated, the longitudinal direction "L" extends along a forward/rearward direction of the electrical connector assembly 100, and defines a mating direction along which one or both of the electrical connector 102 and a complementary connector are moved relative to the other so as to mate with the other electrical connector. For instance, the mating direction of the electrical connector 102 is in a forward direction along longitudinal direction L, and the electrical connector can be unmated from a complementary connector by moving the electrical connector in an opposed longitudinally rearward direction relative to the complementary connector.

Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. Further, the term "in" when used with a specified direction component is intended to refer to the single specified direction, and the term "along" when used with a specified direction component is intended to refer to both directions (i.e., toward and away) of the specified direction component. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector assembly 100 and its components as illustrated merely for the purposes of clarity and convenience, it being appreciated that these orientations may change during use.

Referring now to FIGS. 2-3, in accordance with the illustrated embodiment, the connector housing 112 includes a dielectric or electrically insulative housing body 115 and at least one such as a plurality of alignment members 132 that are supported by the housing body 115. The housing body 115 includes a front end 115*a* and an opposed rear end 115*e* spaced from the front end 115*a* along the longitudinal direction L. The front end 115*a* can define a mating interface 114 that is configured to be mated with the complementary electrical connector so as to place the electrical connector 102 in electrical communication with the complementary electrical connector. The housing body 115 can further include an upper end 115*b* and an opposed lower end 115*d* that is spaced from the upper end 115*b* along the transverse direction T. The lower end 115*d* can define a mounting interface 116 that is configured to be mounted to the printed circuit board 104. The lower end 115*d* can generally lie in a plane defined by the longitudinal and lateral directions A and L, respectively. The housing body 115 can further include first and second opposed sides 115*c* that are spaced from each other along the lateral direction A. While the lateral and longitudinal directions A and L, respectively, extend horizontally and the transverse direction T extends vertically in accordance with the illustrated orientation of the electrical connector system 99, it should be appreciated that the orientation of the electrical connector system can vary as desired.

Each of the ends 115*a-e* can be monolithic with each other and with the connector housing 112. Alternatively, various ones of the ends 115*a-e*, such as the lower and rear ends 115*d* and 115*e*, respectively, can be provided as separate components that can be affixed to the connector housing 112, or can be provided as a separate monolithic component that can be affixed to the connector housing 112. The connector housing 112 can further include a contact block 130 positioned at the front end 115*a* of the housing body 115, such that the contact block 130 carries respective mating ends 122 of the electrical contacts 118. For instance, the contact block 130 can define an interior void 131 that can be bifurcated such that the contact block 130 defines first and second receptacle pockets 114*a-b* that are spaced from each other along the transverse direction T. Thus, the connector housing 112 can define the first and second receptacle pockets 114*a-b*.

Still referring to FIGS. 2-3, the housing body 115, and thus the connector housing 112, presents an exterior surface 113. The exterior surface 113 can include one or more, such as all, of the respective outer or outwardly facing surfaces of the connector housing 112. For instance, the exterior surface 113 at the front end 115*a* can define a front exterior surface 113*a*, the exterior surface 113 at the rear end 115*e* can define a rear exterior surface 113*e* , the exterior surface 113 at the upper end 115*b* can define an upper exterior surface 113*b*, the exterior surface at the lower end 115*d* can define a lower exterior surface 113*d*, and the exterior surface 113 at the sides 115*c* can define respective side exterior surfaces 113*c*. It should be appreciated that the lower exterior surface 113*d* can be disposed at the mounting interface 116 and is configured to face the underlying printed circuit board 104 when the electrical connector 102 is mounted to the printed circuit board 104.

With continuing reference to FIGS. 2-3, the electrical contacts 118 can define respective mating ends 122 that are disposed proximate to the mating interface 114 and are configured to be electrically mated to a complementary electrical component. For instance, the mating ends 122 can be disposed in a receptacle disposed at the mating interface 114, for instance in one of the receptacle pockets 114*a* and 114*b*, respectively. Accordingly, when the electrical connector 102 is mated with the complementary electrical connector, the mating ends 122 are brought into electrical communication with complementary electrical contacts of the complementary electrical connector. The mating ends 122 can be oriented along a mating direction that is perpendicular to the mounting direction M. The electrical contacts 118 further define respective mounting ends that can be configured as mounting tails, such as press-fit tails, that are disposed proximate to the mounting interface 116 and can be configured to be mounted to the underlying printed circuit board 104. For instance, the mounting ends such as mounting tails 124 can be press-fit tails and can be configured to be inserted, or press-fit, into respective vias 105 of the printed circuit board 104 (see FIGS. 5A-6), thereby electrically connecting the mounting tails 124 and the corresponding electrical contacts 118 to respective electrical traces of the printed circuit board 104 when the electrical connector 102 is mounted to the printed circuit board 104. The mounting tails 124 can be oriented along the mounting direction M. The vias 105 can be configured as plated through-holes that electrically connect the mounting tails 124 to respective electrical traces of the printed circuit board 104. While the mounting ends of the electrical contacts 118 are configured as press-fit tails, it should be appreciated that the mounting ends can be configured to be placed in electrical communication with electrical traces of the printed circuit board 104 in accordance with any suitable alternative embodiment. For instance, the mounting ends can be surface mounted and configured to be fused, for instance soldered, to complementary contact pads of the printed circuit board 104.

Each electrical contact 118 can further include an intermediate portion 120 that extends between the mating end 122 and the opposed press-fit tail. Each leadframe assembly 126, and thus the respective electrical contacts 118 of each leadframe assembly 126, can be arranged in respective columns C that extend along the transverse direction T, and can be spaced from the other leadframe assemblies 126 along the lateral direction A, which can define a row direction. The columns C can be oriented substantially perpendicular to the upper surface of the printed circuit board 104 to which the electrical connector 102 is mounted.

The electrical contacts 118 can define receptacle type mating ends 122. Because the mating ends 122 of the electrical contacts 118 are configured as receptacle type mating ends, the electrical connector 102 can be referred to as a receptacle connector. Furthermore, because the mating interface 114 is oriented substantially perpendicular to the mounting interface 116, the electrical connector 102 can be referred to as a right angle connector, though it should be appreciated that the electrical connector 102 can alternatively be constructed in accordance with any desired configuration so as to electrically connect an underlying substrate, such as the printed circuit board 104, to a complementary electrical connector. For instance, the electrical connector 102 can alternatively be constructed as a plug or header type connector with electrical contacts 118 having spade, or plug type mating ends configured to be plugged into, or received by complementary receptacle type mating ends of the electrical contacts of a complementary electrical connector that is to be mated to the electrical connector 102. Additionally, the electrical connector 102 can be configured as a vertical connector, whereby the mating interface 114 is oriented substantially parallel with respect to the mounting interface 116.

The mating ends 122 of the electrical contacts 118 extend forward from the respective leadframe housings 128 along a longitudinal direction L that is substantially perpendicular with respect to the transverse direction T. Thus, the electrical connector 102 is configured to be mated with a complementary electrical connector along the longitudinal direction L, which can define a forward insertion or mating direction. The mounting tails 124 of the electrical contacts 118 extend downward from the respective leadframe housings 128 along the transverse direction T. Thus, it can be said that the mating ends 122 extend along a first or mating direction relative to the connector housing 112, while the mounting tails 124 extend along a second or mounting direction M relative to the connector housing 112 that is substantially perpendicular to the first direction.

The leadframe assemblies 126 can be disposed adjacent to one another in the connector housing 112 along a lateral direction A. Thus, the leadframe assemblies 126 can be spaced along a lateral row direction in the electrical connector 102, thereby defining corresponding laterally spaced columns C of electrical contacts 118. The mounting tails 124 of the electrical contacts 118 of each respective leadframe assembly 126 are spaced substantially along the longitudinal direction L and extend downward from the respective leadframe housings 128 along the transverse direction T. The mating ends 122 of each respective leadframe assembly 126 are spaced along the transverse direction T. The electrical connector 102, for instance the leadframe assemblies 126, can include a dielectric material, such as air or plastic, that electrically isolates individual ones of the electrical contacts 118 from one another.

Referring to FIGS. 4A-6, the connector housing 112 can further include at least one, such as a plurality of first alignment members 132 that are configured to interface with complementary alignment members defined by the shroud 106 so as to fix a relative position between the shroud 106 and the connector housing 112 along at least one or both of the longitudinal and lateral directions L and A, respectively, as discussed in more detail below. The electrical connector assembly 100 can include an electrically conductive shroud 106 that is configured to mount onto the connector housing 112. The shroud 106 includes an upper shroud plate 110 and a shroud body 111. The upper shroud plate 110 defines an upper end **106*a* that is spaced apart from a lower end 106*d* of the shroud body 111 along the transverse direction T. The shroud body can define the lower end 106*d* and first and second opposed side walls 106*b* that are spaced apart from each other along the lateral direction A. The shroud body can further define a rear end 106*c* and a front end 106*e* that is spaced apart from the rear end 106*c* along the longitudinal direction L. While the lateral and longitudinal directions A and L, respectively, extend horizontally and the transverse direction T extends vertically in accordance with the illustrated orientation of the electrical connector system 99, it should be appreciated that the orientation of the electrical connector system can vary as desired. Thus, the shroud 106 can define an interior pocket, or void 134 configured to at least partially enclose the exterior surface 113 of the connector housing 112. Thus, the void 134 can be configured to at least partially enclose the connector housing 112**.

The shroud body 111 can further define a receptacle pocket 108 that can be disposed at the front end **106*e* of the shroud 106. The receptacle pocket can protrude forward in the longitudinal direction with respect to the mating ends 122 of the electrical contacts 118 for instance when the shroud 106 is fully attached to the connector housing 112. The receptacle pocket 108 of the shroud 106 can be configured to receive a complementary mating interface of a complementary electrical connector when mating the complementary connector to the electrical connector 102 so as to align respective mating ends of complementary electrical contacts of the complementary electrical connector with the first and second receptacle pockets 114a-b of the connector housing 112**.

The shroud 106 can include at least one, such as a plurality of mounting members 136, that are configured to be received by complementary apertures defined in an underlying substrate, such as the printed circuit board 104. In accordance with the illustrated embodiment, the shroud 106 defines a pair of mounting members 136 in the form of legs 137, each leg 137 extending downward in a transverse direction with respect to the lower end **106*d* of the shroud 106. Each mounting member 136 can be configured to be received in a respective complementary aperture 138 of the underlying substrate. For instance, the complementary apertures 138 extend at least into the upper surface of the printed circuit board 104. The illustrated mounting members can be oriented along a direction that is substantially perpendicular to the mating direction. Thus, it can be said that the mounting member 136 projects out from the shroud body 111** in the mounting direction M.

Still referring to FIGS. 4A-6, the mounting members 136 (i.e., legs 137) are disposed, or located at approximately the midpoint between the front end **106*e* and the rear end 106*c* along the longitudinal direction L. The illustrated legs 137 have a substantially cylindrical cross section. It should be appreciated that the shroud 106 is not limited to the illustrated mounting members, and that the shroud 106 can alternatively be constructed with any other suitable mounting members, as desired. For instance, the shroud 106** can be alternatively constructed with more or fewer mounting members, mounting members having the same or different geometries, mounting members disposed in different locations on the shroud body, or any combination thereof.

Figure 6:
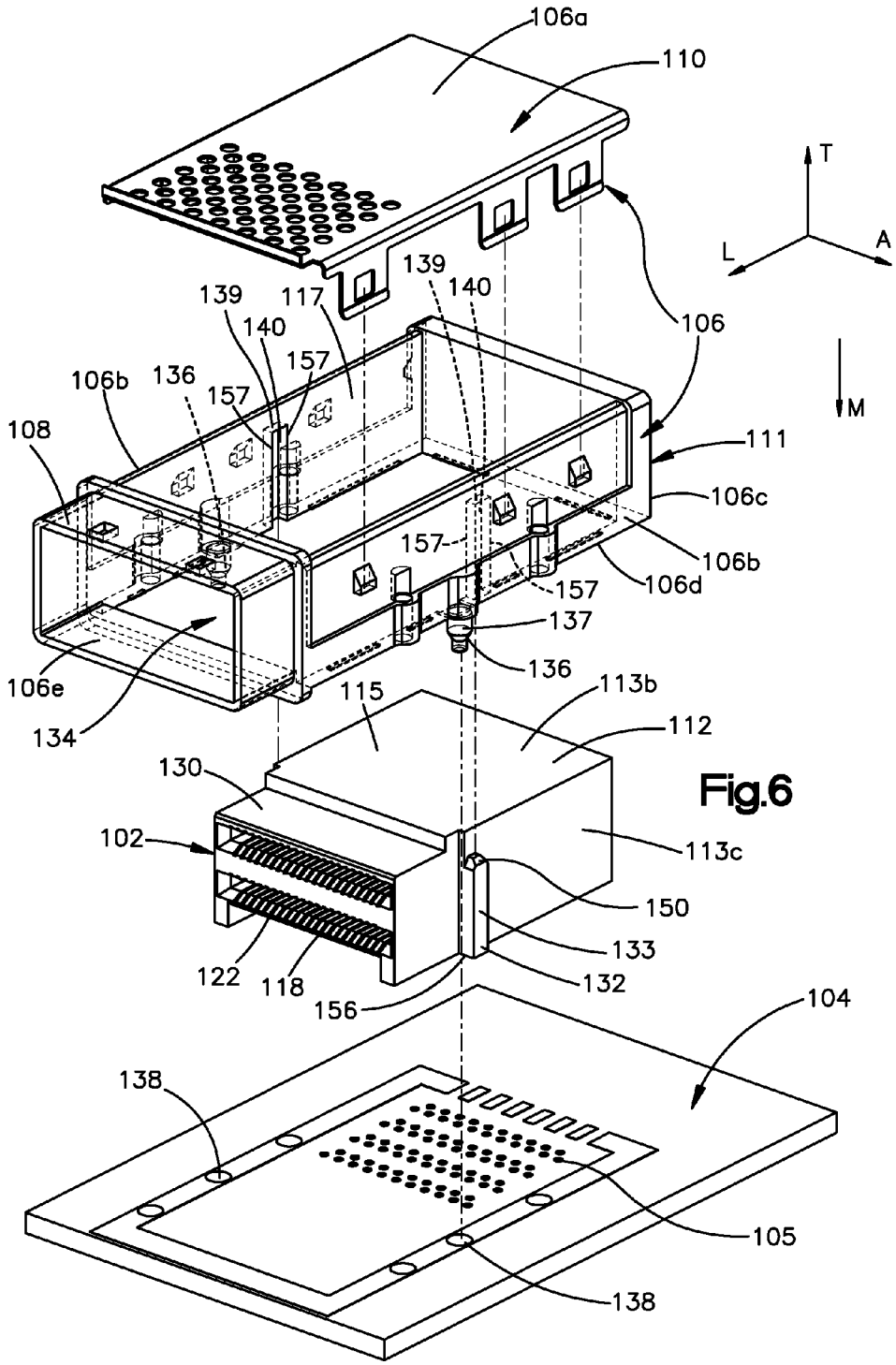
FIG. 6 is an exploded view of the electrical connector system shown in FIG. 1.

Referring to FIG. 6, the shroud body 111 defines an interior surface 117 that faces the exterior surface 113 of the connector housing 112 when the shroud 106 is fit over the connector housing 112. The interior surface 117 can include one or more, such as all, of the respective inner, or inwardly facing, surfaces of the shroud body 111. For example, the interior surface can include laterally opposed side surfaces corresponding to the respective inwardly facing surfaces of the opposed side walls 106*b*, and a rear surface corresponding to the inwardly, or forward facing surface of the rear end 106*c*, or any combination thereof. In accordance with an example embodiment, the interior surface can include at least one, such as all of the inner surfaces of the shroud 106 that define the void 134.

The shroud 106 can further include at least one, such as a plurality of second alignment members 139. The alignment members 139 of the shroud 106 can include a recess 140 that is supported by the interior surface 117 of the shroud body 111. The alignment members 139 of the shroud 106 can be configured to interface with complementary alignment members of the connector housing 112. The alignment member 139 can include one or more sides that define the recess 140. In accordance with the illustrated embodiment, the shroud 106 includes a pair of second alignment members 139 that include opposed sides 157 and an upper end 159 that define recesses 140 in the interior surface 117 of the shroud body 111. Each recess 140 can be bound by the opposed sides 157, that are spaced from each other along a select direction, which can be the longitudinal direction L, (see also FIGS. 9A-D), and an upper end 159 which can extend along the select direction, which can be the longitudinal direction L, between the opposed sides 157, for instance from one opposed side 157 to the other opposed side 157. The upper end 159 can be disposed proximate to the upper end 106*a* of the shroud 106. For instance, each recess 140 can be elongate (i.e., oriented) in the mounting direction M and can extend upward in a transverse direction T from the lower end 106*d* of the shroud body 111 until the recess terminates at the upper end 159. Thus, it can be said that the recesses 140 are oriented in a direction substantially perpendicular to the select direction. Referring also to FIGS. 9A-D, it can be said that each of the second alignment members 139 (i.e., recesses 140) of the shroud 106 have an initial thickness T1 along the select direction, and the initial thickness can be defined by the distance between the opposed sides 157 that define each recess 140 along the select direction, which can be the longitudinal direction L. Because the recesses 140 can be supported by the interior surface 117 of the shroud body 111, they can be referred to as interior alignment members.

Figure 7:
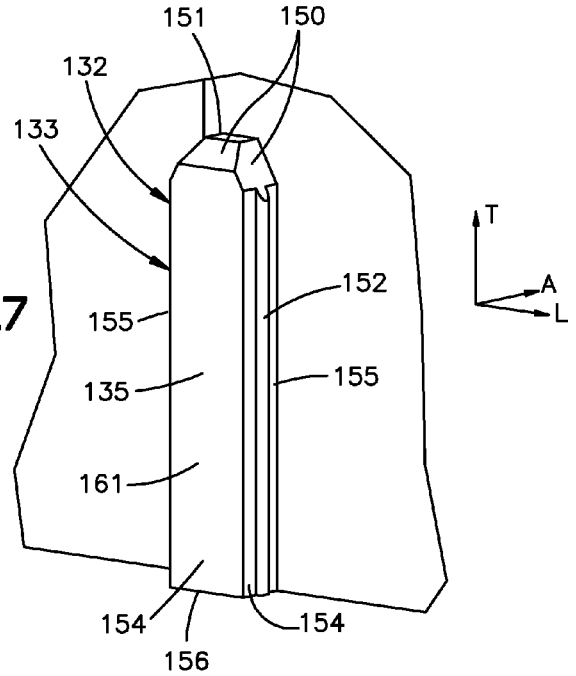
FIG. 7 is a perspective view of an alignment member of the connector housing in accordance with an embodiment.

Referring also to FIG. 7, the connector housing 112 can further include at least one, such as a plurality of first alignment members 132, that are configured to be received by complementary alignment members of the shroud 106. The alignment members 132 can be supported by the housing body 115, for instance at the exterior surface 113. In accordance with the illustrated embodiment, the alignment members 132 are carried by the side exterior surfaces 113*c*, though it should be appreciated that the alignment members 132 can be carried by any alternative exterior surface as desired. In accordance with the embodiment illustrated in FIGS. 3 and 6, the connector housing 112 includes a pair of first alignment members 132 that are supported by respective ones of the side exterior surfaces 113*c* of the opposed sides 115*c* of the connector housing 112. The first alignment members 132 can project out from the exterior surface 113 of the housing body 115, and thus of the connector housing 112.

Each of the first alignment members 132 can include an alignment body 135 and at least one compressible crush rib 152 that projects out from the alignment body 135, for instance along a direction that is perpendicular to the mounting direction M. The alignment members 132 can be configured as ribs 133 in accordance with one embodiment. For instance, each rib 133 can be elongate in the mounting direction M and can protruding out from the exterior surface 113 of the connector housing 112, for instance along the lateral direction A, and in particular from the exterior side surfaces 113*c* of the sides 115*c*. Each of the illustrated alignment members 132 extend out from a respective one of the exterior side surfaces 113*c* of the sides 115*c* along the lateral direction, and can further extend along the transverse direction T between the upper end 115*b* and the lower end 115*d*, for instance from the upper end 115*b* to the lower end 115*d*. The alignment body 135, and thus the first alignment member 132, can define a first end or lower end 156 and a second end or upper end 151, the first end (i.e., lower end 156) of the first alignment member 132 can be disposed closer to the underlying substrate than the second end (i.e., upper end 151) of the first alignment member 132 when the electrical connector 102 is mounted onto the underlying substrate (i.e., printed circuit board 104). For instance the lower end 156 can be disposed proximate to the lower end 115*d* of the housing 112, and the upper end 151 can be disposed proximate to the upper end 115*b* of the housing 112. The second end or upper end 151 of the first alignment member 132 can be tapered, and can define a leading end with respect to engagement with a complementary alignment member 139 of the shroud 106 as described in more detail below. For instance, the alignment member 132 can include an upper end 151 that has tapered edges 150 so as to allow the alignment member 132 to be easily guided into the complementary alignment members 139 of the shroud 106. Because the alignment members 132 (i.e., ribs 133) can be supported by the exterior surface 113 of the connector housing 112, they can be referred to as exterior alignment members.

Referring again to FIGS. 7 and 9A-D, the alignment body 135 can define an outwardly-facing exterior surface 154, which can include a pair of opposed sides 155 that are spaced from each other, for instance along the select direction which can be the longitudinal direction L, and an outer end 161 that extends between the opposed sides 155 along the longitudinal direction L. The crush rib 152 can project out from the exterior surface 154, for instance from one of the opposed sides 155 along the select direction. As illustrated, the select direction is the longitudinal direction L, though it should be appreciated that the select direction can be the lateral direction A, for instance when the crush rib 152 alternatively extends out from the outer end 161. Each crush rib 152 can be elongated along the mounting direction M from a first end proximate the first end (i.e., lower end 156) of the first alignment member 132 toward an opposed second end proximate a second end (i.e., upper end 151) of the first alignment member 132. Thus, it can be said that the alignment members 132 are oriented in a direction substantially perpendicular to the select direction. Further, it can be said that each of the first alignment members 132 (i.e., ribs 133) of the connector housing 112 have an initial thickness T2 along the select direction, and the initial thickness T2 is defined by the sum of the distance between the opposed sides 155 along the select (i.e., longitudinal) direction and the distance that the crush rib 152 projects from an opposed side 155 along the select direction. Thus, the thickness of an alignment member 132 of the connector housing 112 can be decreased when the crush rib 152 is compressed, so that the alignment member 132 can have a thickness T3 that is less than the initial thickness T2.

The electrical connector 102 is configured to be mounted onto an underlying substrate along a mounting direction M. For instance, the first alignment member 132 (i.e., rib 133) of the connector housing 112 can be configured to be received by the second alignment member 139 (i.e., recess 140) when the shroud 106 is mounted onto the connector housing, so that the mounting member 136 is aligned with the complementary aperture 138, and movement of the shroud 106 along the electrical connector 102 causes the mounting member 136 to be received in the complementary aperture 138 and the first alignment member 132 to be compressed by one of the opposed sides 157 that define the recess 140 (i.e., the second alignment member) so that the thickness T3 of the first alignment member 132 decreases to be no greater than the thickness T1 of the second alignment member 139. For instance, one of the opposed sides 157 of the alignment member 139 can be configured to compress the crush rib 152 as the shroud 106 is fit over the connector housing 112. Alternatively, at least one alignment member of the shroud 106 can be received by at least one corresponding alignment member of the connector housing 112. Thus, it can be said that one of the first and second alignment members can be configured to be received by the other of the first and second alignment members when the shroud 106 is mounted onto the connector housing 112 so that the mounting member 136 is received in the complementary aperture 138, and the received one of the first and second alignment members can be compressed by the other of the first and second alignment members so that the thickness of the received one of the first and second alignment members decreases to be no greater than the thickness of the other of the first and second alignment members. As further described herein, the first alignment member is not limited to including one compressible crush rib 152 projecting outward from one opposed side 155. For instance, the first alignment member 132 can include at least a second compressible crush rib that projects out from the other of the opposed sides 155 along the select direction. Thus, the other opposed side 157 of the alignment member 139 can be configured to compress the second crush rib as the shroud 106 is fit over the connector housing 112.

The alignment members 139 of the shroud 106 can include recesses 140 that can be located, or disposed in the interior surface 117 of the shroud body 111 such that when the alignment members 132 that are supported by the exterior surface 113 of connector housing 112 are received in the recesses 140 as the shroud 106 is mounted onto, or attached to the connector housing 112, the front edge of the upper end 106*a* of the shroud 106 is substantially aligned with the front edge of the printed circuit board 104 along the transverse direction.

The recesses 140 can be sized to receive the ribs 133 in a press, or friction fit, such that the recesses 140 and the ribs 133, and thus the shroud 106 and the connector housing 112, define a mechanical interference that resists movement of the shroud 106 along the connector housing 112, as described in more detail below. For instance, referring to FIGS. 8A-B, the recess 140 can be sized to receive the alignment member 132 to define a void 158 between the exterior surface of the rib 133 and the interior surface of the recess 140. As the shroud 106 moves along the connector housing 112 in the mounting direction M, the crush rib 152 is compressed and the void 158 can be at least partially filled by the crush rib 152 after the crush rib 152 is compressed, thereby applying mechanical interference such as a retention force (i.e., a press fit) between the shroud 106 and the connector housing 112. It should be appreciated that the shroud 106 is not limited to the illustrated alignment members, and that the shroud 106 can alternatively be constructed with any other suitable alignment members, as desired. For instance, the shroud 106 can be alternatively constructed with more or fewer alignment members, alignment members having the same or different geometries, alignment members disposed in different locations on the shroud, or any combination thereof.

The illustrated alignment members 132 (i.e., ribs 133) are located, or disposed at substantially the front edges of the respective sides 115*c*, proximate the rear end of the contact block 130. The illustrated ribs 133 have a height equal to approximately three quarters of the transverse height of the connector housing 112. The compressible crush ribs 152 can have a height that is substantially equal to the ribs 133. The illustrated crush rib 152 has a height that is substantially equal to the distance between the lower end 156 of the rib 133 and the bottom of the tapered edge 150 along the mounting direction M. It should be appreciated that the connector housing 112 is not limited to the illustrated alignment members, and that the connector housing 112 can alternatively be constructed with any other suitable alignment members, as desired. For instance, the connector housing 112 can alternatively be constructed with more or fewer alignment members, alignment members having the same or different geometries, alignment members disposed at different locations on the exterior surface 113 of the connector housing 112, or any combination thereof. Further, it should be appreciated that the alignment member 132 is not limited to the illustrated crush ribs, and that the alignment member 132 can alternatively be constructed with any suitable crush ribs, as desired. For instance, the alignment member 132 can alternatively be constructed with more or fewer crush ribs, crush ribs having the same or different geometries, crush ribs disposed at various locations on the exterior surface 154 of the alignment member 132, or any combination thereof.

It should further be appreciated that the exterior alignment members of the connector housing 112 need not extend outwardly from the exterior surface 113 of the connector housing 112. For example, the exterior surface 113, such as the exterior side surfaces 113*c*, can define exterior alignment members in the form of recesses that are recessed in the respective exterior side surfaces 113*c*. Similarly, the interior alignment members of the shroud 106 need not include recesses 140 that are recessed in the interior surface 117 of the shroud 106. For example, the interior surface, such as the inner surfaces of each of the side walls 106*b* can define respective interior alignment members in the form of ribs that project out from the respective side walls 106*b*, in respective directions toward the center of the shroud. It should still further be appreciated that the exterior alignment members of the connector housing 112 and the interior alignment members of the shroud 106 can be defined as any combination of alignment members that are recessed in, or project out from the exterior and interior surfaces of the connector housing 112 and shroud 106, respectively.

Figure 4A:
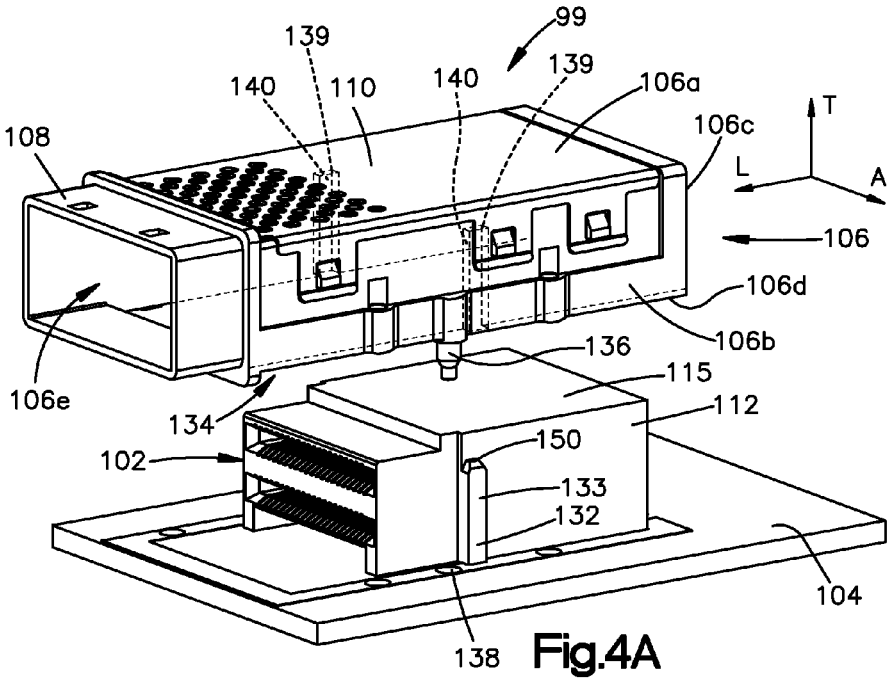
FIG. 4A is a perspective view of the electrical connector system showing the shroud aligned to be mounted onto the electrical connector and the underlying substrate.
Figure 4B:
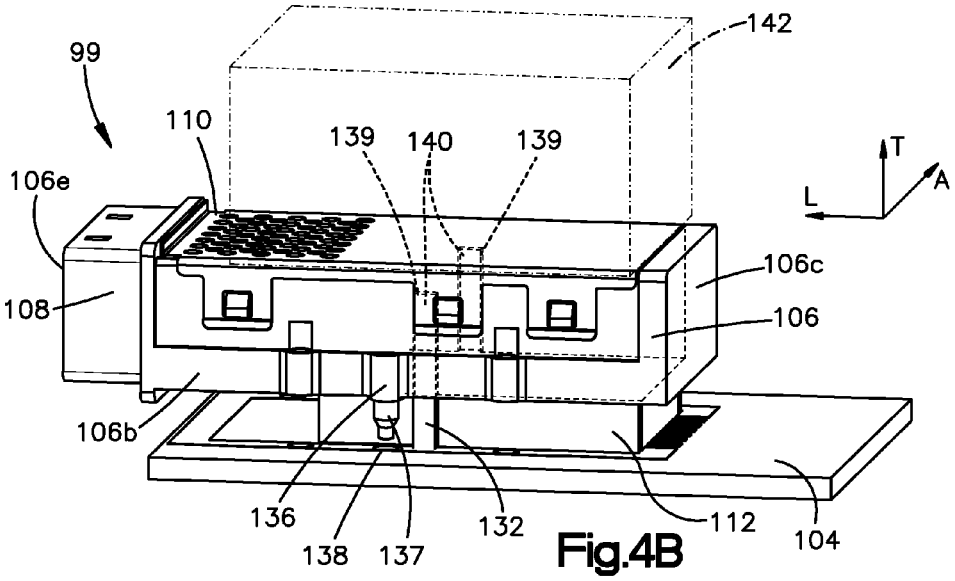
FIG. 4B is a perspective view of the electrical connector system showing the shroud mounted onto the electrical connector and aligned for mounting to the underlying substrate.

Referring now to FIGS. 4A-B, in accordance with the illustrated embodiment, the connector housing 112 and the shroud 106 can be separately mounted to the printed circuit board 104. For instance, in a first step the mounting tails 124 of the electrical contacts 118 carried by the connector housing 112 can be aligned with respective vias 105 defined in the printed circuit board 104, and the connector housing 112 can be mounted to the printed circuit board 104 by applying a force against the connector housing 112 along the mounting, or transverse direction T such that the mounting tails 124 are biased into the respective vias 105, and the lower end 115*d* of the connector housing 112 abuts the upper surface of the printed circuit board 104.

In a second step, the shroud 106 can be mounted to the connector housing 112, for instance by aligning first alignment members 132 of the connector housing 112, such as the ribs 133, with complementary second alignment members 139 of the shroud 106 (see FIG. 9A), and applying a force against the shroud 106 along the mounting direction M. As the force is applied, the ribs 133 can slidably move within the recesses 140 (see FIGS. 9B-D), such that the shroud 106 advances downward toward the printed circuit board 104. The first and second alignment members 132 and 139, respectively, can cooperate to align the mounting members 136 of the shroud 106, such as the legs 137, with respect to respective ones of the apertures 138 in the printed circuit board 104, such that as the shroud 106 is moved downward relative to the connector housing 112, the legs 137 are received in the respective apertures 138. It should be appreciated that the first and second alignment members, in combination with tooling located rearward of the front edges of the upper end and side walls 106*a* and 106*b*, respectively, of the shroud 106, can enable the utilization of flat-rock machinery 142 to mount the shroud 106 onto the connector housing 112.

Referring again to FIGS. 5A-B, in accordance with the illustrated embodiment, the shroud 106 and the connector housing 112 can be configured such that the shroud 106 can be mounted onto the connector housing 112 in a first position relative to the connector housing 112 and a second position that is offset, or staggered, with respect to the first position in the mounting direction M. The first position (see FIG. 9C) can be a partially mounted (staggered) position of the shroud 106 with respect to the connector housing 112, and the second position (see FIG. 9D) can be a fully mounted position of the shroud 106 with respect to the connector housing 112.

Referring also to FIGS. 9A-D, the shroud 106 can be operated between the first position and second positions, for instance after the connector housing 112 has been mounted to the printed circuit board 104. In an example mounting procedure in accordance with the illustrated embodiment, the electrical connector assembly 100 can be mounted to the printed circuit board 104 with the shroud 106 in the first, or staggered position relative to the connector housing 112. As the electrical connector assembly 100 is further mounted to the printed circuit board 104, the shroud 106 can be operated from the staggered position relative to the connector housing 112 to the second, or fully mounted position with respect to the printed circuit board 104. In the second or fully mounted position, the mounting members 136 of the shroud 106, such as the legs 137, can be received in respective ones of the apertures 138 in the printed circuit board 104. The first and second alignment members 132 and 139 of the connector housing 112 and the shroud 106, respectively, can cooperate to align the mounting members 136 of the shroud 106 with the respective apertures 138 as the electrical connector is mounted to the printed circuit board 104.

Referring again to FIGS. 5A-B, the shroud 106 can be pre-mounted (i.e., partially mounted) to the connector housing 112, in the first mounted position (i.e., a partially mounted position), before the connector housing 112 is mounted to the printed circuit board 104. Therefore, separate mounting of the connector housing 112 to the printed circuit board 104 followed by attachment of the shroud to the mounted connector housing 112 is not required. The shroud 106 can be mounted on the connector housing 112 in the partially mounted position relative to the connector housing 112, such that the shroud 106 is attached to the connector housing 112 and the connector housing 112 extends further in the mounting direction M than the shroud 106 when the shroud 106 is in the partially mounted position. When the shroud 106 is mounted to the connector housing 112 in the first position, the mounting tails 124 of the electrical contacts 118 that are oriented in the mounting direction M extend further in the mounting direction M (i.e., lower) with respect to the upper end 115*b* of the connector housing 112 than do the mounting members 136 of the shroud 106. More specifically, each press-fit tail of the electrical contacts 118 is disposed proximate to the mounting interface 116 and can terminate at a location that is spaced from the upper exterior surface 113*b* of the connector housing 112 a first distance D1 along the mounting direction M. When the shroud 106 is in the first position, the mounting members 136 can terminate at a location that is spaced from the upper exterior surface 113*b* of the connector housing 112 a second distance D2 that is shorter than the first distance D1. Further, the shroud 106 and the connector housing 112 define a mechanical interference that resists movement of the shroud 106 along the connector housing 112 from the first position to the second position, such that when a force is applied to the shroud that overcomes the mechanical interference, the shroud moves from the first position toward the second position, thereby moving the mounting member 136 toward the complementary aperture 138. Such a force can be applied in the mounting direction M and can cause the shroud 106 to move from the first position to the second position.

For instance, the second alignment member 139 of the shroud 106 can be configured to mechanically interfere with the first alignment member 132 of the connector housing 112 so as to provide the mechanical interference when the shroud 106 is in the first position. More specifically, the first alignment member 132 can be configured to be received by the second alignment member 139, and the first alignment member can include at least one compressible crush rib 152 that is configured to mechanically interfere with the shroud 106 when the shroud 106 is in the first position. Force can be applied to overcome the mechanical interference and cause the shroud 106 to compress the crush rib 152 such that the second alignment member 139 further receives the first alignment member 132 as the shroud moves from the first position toward the second position.

Figure 8A:
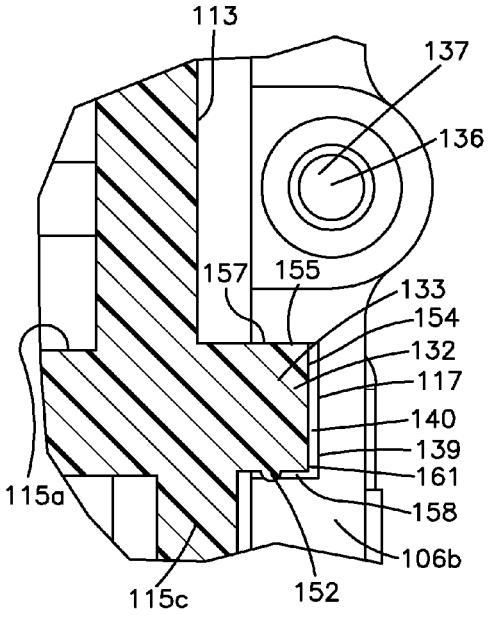
FIG. 8A is a bottom plan view of a portion of the electrical connector assembly, showing the alignment member of the connector housing illustrated in FIG. 7 attached to an alignment member of the shroud in accordance with an embodiment.
Figure 8B:
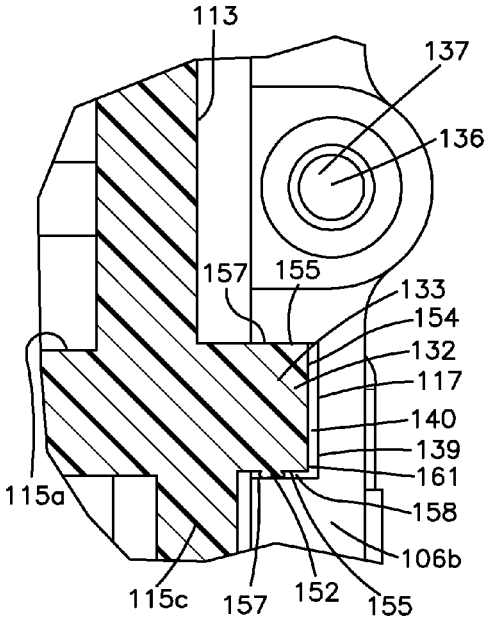
FIG. 8B is a cross-sectional top plan view of a portion of the electrical connector assembly, showing the alignment member of the connector housing illustrated in FIG. 7 attached to an alignment member of the shroud in accordance with the embodiment illustrated in FIG. 8A.

The shroud 106 and/or the connector housing 112 can be configured to define a mechanical interference when the shroud 106 is attached to the connector housing 112 in the first position, and the mechanical interference can be of sufficient magnitude to resist movement of the shroud 106 from the first position to the second position, that is to retain the shroud 106 in the first position, during mounting of the connector housing 112 to the printed circuit board 104. The mechanical interference can be generated, for instance due to the respective geometries of the first and second alignment members. For example, at least a portion, such as the entirety of the ribs 133 and/or the recesses 140 can be sized and/or shaped such that once the ribs 133 have advanced into the recesses 140 a distance such that the shroud 106 is in the first position relative to the connector housing 112, the magnitude of the force resisting further advancement of the ribs 133 within the recesses 140 (i.e., the mechanical interference) is greater than the force required to cause the mounting tails 124 of the electrical contacts to be inserted into the respective vias 105 of the printed circuit board 104. Referring to FIGS. 8A-B, the mechanical interference can be generated due to interaction between the crush rib 152, the alignment body 135, and the recess 140. For instance, as the recess 140 is advanced downward toward the lower end 156 of the alignment member 132, an increased portion of the crush rib 152 is compressed to at least partially fill the void 158 between the exterior surface 154 of the first alignment member 132 and at least one of the sides 157 of the second alignment member 139 (see FIG. 8B). For instance, the crush rib 152 can be compressed to at least partially fill the void 158 between one of the sides 155 of the first alignment member and one of the sides 157 of the second alignment member 139 in accordance with the illustrated embodiment. In accordance with an example embodiment, the mounting tails 124 can be configured to be fully inserted into the respective vias 105 before the shroud 106 is in the fully mounted second position with respect to the connector housing 112 along the mounting direction M. Alternatively, the connector housing 112 can be configured to be mounted to the shroud 106 before the mounting tails 124 are fully inserted into the respective vias 105. In such an embodiment, the upper ends 159 of the second alignment member 139 can apply a force in the mounting direction M on the upper end 151 of the alignment member 132 of the connector housing 112, thereby moving the electrical connector 102 in the mounting direction M to a fully mounted position with respect to the printed circuit board 104. When the shroud 106 is attached to the connector housing 112 in the second position, substantially all of the crush rib 152 can be compressed, either elastically or plastically. The crush rib 152 can be comprised at least in part of plastic such as a liquid crystal polymer, although it will be understood that any appropriate material can be used. Further, the crush rib 152 can be integral and monolithic with the alignment member 132 of the connector housing 112. Alternatively, the crush rib 152 can be provided as a separate component that can be affixed to the alignment member 132, and thus to the connector housing 112.

In operation, the shroud 106 can be attached to the connector housing 112 in the first position by placing the shroud over the connector housing so that the alignment member 132 of the connector housing 112 is at least partially received by the alignment member 139 of the shroud 106. With the shroud 106 attached to the connector housing 112 in the first position (see FIG. 9C), the electrical connector 102 can be mounted to the printed circuit board 104. In the illustrated embodiment, the first position occurs when approximately half of the alignment member 132 is received by the recess 140, but varying lengths of the alignment member 132 can be received by the recess 140 in the first position in accordance with various embodiments. In accordance with the illustrated embodiment, when the shroud 106 is in the first position, the shroud 106 does not interfere with a line of sight to the ends of the mounting tails 124 that terminate in the mounting direction M, wherein the line of sight is along a direction that is substantially perpendicular to the mounting direction M. For instance, while the shroud 106 is in the first position, the lower end 106*d* of the shroud body 111 can be spaced above, along the mounting direction M, at least the ends of the mounting tails 124 that terminate in the mounting direction M. In accordance with the illustrated embodiment, the opposed side walls 106*b* and the lower end 106*d* are spaced above the lower exterior surface 113*d* of the connector housing 112 along the mounting direction M while the shroud 106 is in the first position.

Because the mounting tails 124 of the electrical contacts 118 can protrude beyond the distal ends of the mounting members 136, the mounting members 136 do not interfere with aligning the mounting tails 124 with the respective vias 105 of the printed circuit board 104. Thus, the mounting tails 124 can be aligned along the mounting direction M with the complementary vias 105 of the underlying substrate while the shroud 106 is in the first position, such that the mounting tails 124 are at least partially received in the complementary vias 105. Because the magnitude of the force required to cause the mounting tails 124 to be inserted into the vias 105 can be less than that required to overcome the mechanical interference between the shroud 106 and the connector housing 112, the connector housing 112 can be mounted to the printed circuit board 104 before the shroud moves from the first position toward the second position along the mounting direction M.

Thus, while the shroud 106 is in the first position the mounting tails 124 can be aligned with the corresponding vias 105 of the printed circuit board without the shroud 106 interfering with a view, for instance a view from a direction that is perpendicular to the mounting direction M, of the mounting tails 124 and the corresponding vias 105. Therefore, the connector housing 112 and shroud 106 can be mounted to the printed circuit board 104 without breaking or bending the mounting tails 124.

Once the mounting tails 124 have been inserted into the vias 105 such that the connector housing 112 is seated in its mounted position against the printed circuit board 104, continued application of force to the shroud 106 along the mounting direction M can build up and reach a magnitude greater than the mechanical interference of the shroud 106 and the connector housing 112, at which point the mechanical interference can be overcome and the shroud 106 can slidably move from the first position (see FIG. 9C) toward the second position (see FIG. 9D) along the mounting direction M. The force can be applied in the mounting direction M to the shroud 106 until the shroud 106 is in the second position, thereby moving at least one mounting member 136 toward the complementary aperture 138 until it is received by the complementary aperture. As the shroud 106 is operated from the first position to the second position, the first and second alignment members 132 and 139, respectively, can cooperate to align the mounting members 136 of the shroud 106 with the respective apertures 138 in the printed circuit board 104, such that as the shroud 106 is advanced from the first position to the second position, the mounting members 136 are received in the apertures 138.

Figure 5A:
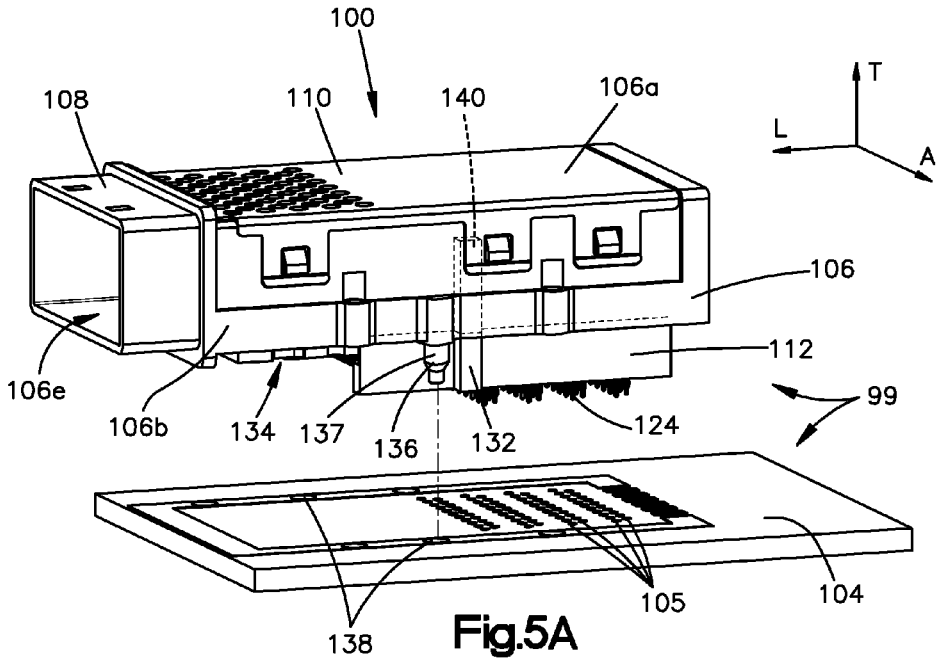
FIGS. 5A-B are perspective views of the electrical connector system illustrated in FIG. 1, showing the shroud mounted to the electrical connector prior to mounting the electrical connector to the underlying substrate.
Figure 5B:
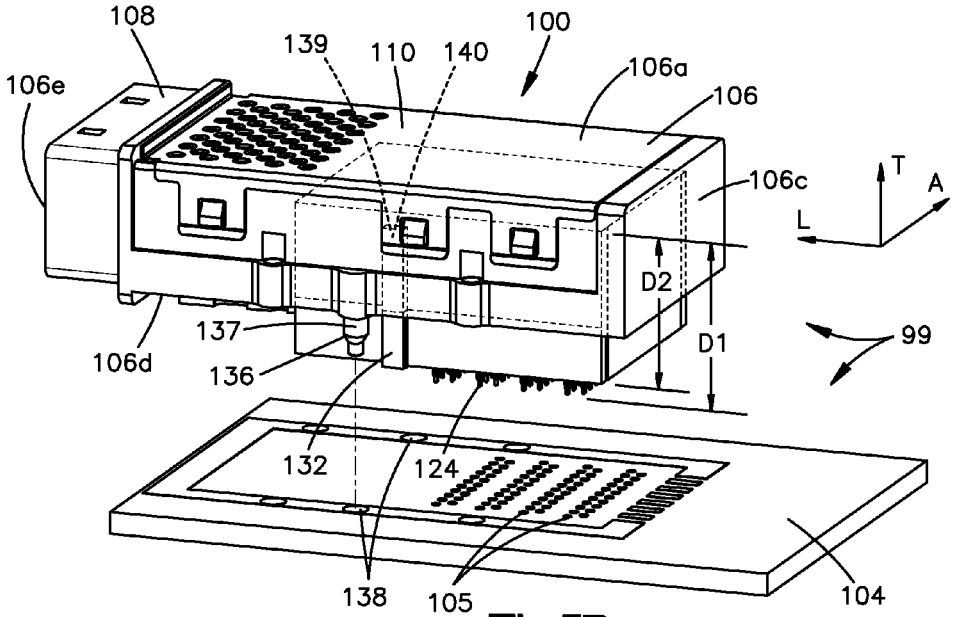

Still referring to FIGS. 5A-B, the above-described method of mounting the electrical connector assembly 100 to the printed circuit board 104 can also be achieved utilizing flat-rock techniques, if the appropriate tooling is used. It should be appreciated that generation of the mechanical interference is not limited to the geometries and properties of the alignment members 132 of the connector housing 112 and the alignment member 139 of the shroud 106, and that the mechanical interference can be generated due to other characteristics of the electrical connector assembly 100. For example, the shroud 106 and/or the connector housing 112 can include a mechanical retention member, the retention member configured to retain the shroud 106 in the first position relative to the connector housing 112 until the magnitude of a force applied to the shroud 106 along the mounting direction M exceeds that required to cause the retention member to fail, the failure of the retention member releasing the shroud 106 to move from the first position to the second position relative to the connector housing 112. The retention member can include at least one, such as a plurality of retention members, the at least one retention member being integral with one or more first alignment members of the connector housing 112, integral with one or more second alignment members of the shroud 106, or separately affixed to the connector housing 112 or the shroud 106, or any combination thereof.

Figures 9A, 9B, 9C, 9D:
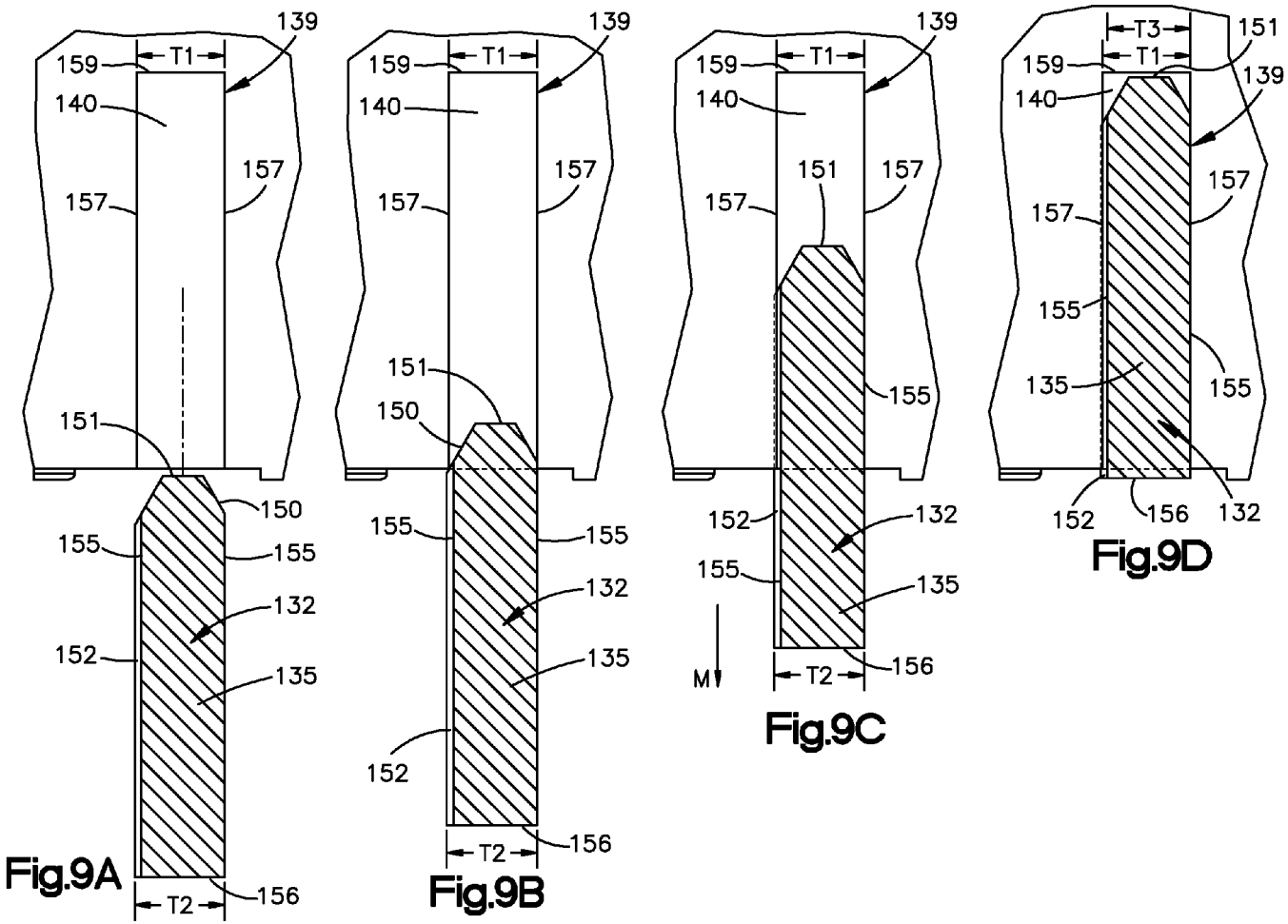
FIG. 9A is a sectional side elevation view of a portion of the electrical connector assembly, showing the alignment member of the shroud aligned to be attached to the alignment member of the connector housing along a mounting direction in accordance with one embodiment.
FIG. 9B is a sectional side elevation view of a portion of the electrical connector assembly, showing the alignment member of the shroud partially attached to the alignment member of the connector housing.
FIG. 9C is a sectional side elevation view of a portion of the electrical connector assembly, showing the alignment member of the shroud further attached to the alignment member of the connector housing.
FIG. 9D is a sectional side elevation view a portion of the electrical connector assembly, showing the alignment member of the shroud fully attached to the alignment member of the connector housing.

It should be appreciated that the electrical connector 102 can be provided with the shroud 106 pre-mounted to the connector housing 112, in the first, or staggered position (See FIGS. 5A-B and 9C). Alternatively the shroud 106 and the connector housing 112 can be provided unattached, and can be attached to one another in the first position prior to mounting the electrical connector 102 to the printed circuit board 104.

Although the staggered mounting electrical connector assembly has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described staggered mounting electrical connector. Those skilled in the relevant art, having the benefit of the teachings of this specification, may effect numerous modifications to the staggered mounting electrical connector as described herein, and changes may be made without departing from the scope and spirit of the instant disclosure, for instance as recited in the appended claims.

What is claimed:

1. An electrical connector assembly configured to be mounted onto an underlying substrate along a mounting direction, the electrical connector assembly comprising:

an electrical connector including a dielectric connector housing and at least one electrical contact carried by the connector housing, the at least one electrical contact including a mounting tail configured to be mounted to the underlying substrate and a mating end configured to be electrically mated to a complementary electrical component, the connector housing including at least one first alignment member that includes an alignment body and at least one compressible crush rib that projects out from the alignment body along a select direction, wherein the at least one first alignment member has a thickness along the select direction; and an electrically conductive shroud configured to fit over the connector housing, the shroud including at least one second alignment member having a thickness along the select direction, the shroud further including a mounting member configured to be received in a complementary aperture of the underlying substrate, wherein the first alignment member is configured to be received by the second alignment member when the shroud is mounted onto the connector housing so that the mounting member is aligned with the complementary aperture, and the crush rib is compressed and remains compressed by the second alignment member so that the thickness of the first alignment member decreases to be no greater than the thickness of the second alignment member.

2. The electrical connector assembly as recited in claim 1, wherein the connector housing includes a housing body that defines an exterior surface, and the at least one first alignment member is supported by the exterior surface.

3. The electrical connector assembly as recited in claim 2, wherein the at least one first alignment member projects out from the exterior surface.

4. The electrical connector assembly as recited in claim 3, wherein the shroud includes a shroud body that defines an interior surface that faces the exterior surface of the connector housing when the shroud is fit over the connector housing, and the at least one second alignment member comprises a recess that is supported by the interior surface.

5. The electrical connector assembly as recited in claim 4, wherein the at least one second alignment member comprises one or more sides that define the recess defined by the interior surface of the shroud body, the recess bound by opposed sides of the second alignment member that are spaced from each other along the select direction, wherein one of the opposed sides of the second alignment member is configured to compress the crush rib as the shroud is fit over the connector housing.

6. The electrical connector assembly as recited in claim 5, wherein the mounting member projects out from the shroud body in the mounting direction.

7. The electrical connector assembly as recited in claim 6, wherein the at least one crush rib is elongate along the mounting direction from a first end proximate a first end of the at least one first alignment member toward an opposed second end proximate a second end of the at least one first alignment member, the first end of the at least one first alignment member disposed closer to the underlying substrate than the second end of the at least one first alignment member when the electrical connector is mounted onto the underlying substrate.

8. The electrical connector assembly as recited in claim 7, wherein the second end of the at least one first alignment member is tapered.

9. The electrical connector assembly as recited in claim 5, wherein the at least one first alignment member comprises a second compressible crush rib that projects out from the other of the opposed sides along the select direction, and the other of the opposed sides of the second alignment member is configured to compress the second crush rib as the shroud is fit over the connector housing.

10. The electrical connector assembly as recited in claim 1, wherein the mounting tail of the at least one electrical contact is a press-fit tail.

11. An electrical connector assembly configured to be mounted to an underlying substrate along a mounting direction, the electrical connector assembly comprising:

an electrical connector including a dielectric connector housing and a plurality of electrical contacts carried by the connector housing, the connector housing presenting a lower exterior surface that defines a mounting interface configured to be mounted onto the underlying substrate and an upper exterior surface that is opposite the lower exterior surface, each electrical contact defining a mating end and a mounting tail, wherein each mounting tail is disposed proximate to the mounting interface and terminates at a location that is spaced from the upper exterior surface a first distance along the mounting direction; and an electrically conductive shroud configured to be mounted onto the connector housing in a first position relative to the connector housing and a second position that is offset with respect to the first position in the mounting direction, the electrically conductive shroud including at least one mounting member that is configured to be received in a complementary aperture of the underlying substrate when the shroud is in the second position, the mounting member terminating at a location that is spaced from the upper exterior surface of the connector housing a second distance that is shorter than the first distance when the shroud is mounted onto the connector housing in the first position, wherein the shroud and the connector housing define a mechanical interference that resists movement of the shroud along the connector housing from the first position to the second position, such that when a force is applied to the shroud that overcomes the mechanical interference, the shroud moves from the first position toward the second position, thereby moving the mounting member toward the complementary aperture, wherein the connector housing further includes a first alignment member and the shroud includes a second alignment member that is configured to mechanically interfere with the first alignment member so as to provide the mechanical interference when the shroud is in the first position, and wherein the first alignment member is configured to be received by the second alignment member, and the first alignment member comprises at least one compressible crush rib that is configured to mechanically interfere with the shroud when the shroud is in the first position.

12. The electrical connector assembly as recited in claim 11, wherein the force causes the shroud to move from the first position to the second position.

13. The electrical connector assembly as recited in claim 11, wherein the mating ends are oriented along a direction that is perpendicular to the mounting direction.

14. The electrical connector assembly as recited in claim 13, wherein the mounting tails are oriented along the mounting direction.

15. The electrical connector assembly as recited in claim 11, wherein the force causes the shroud to compress the crush rib such that the second alignment member further receives the first alignment member as the shroud moves from the first position toward the second position.

16. The electrical connector assembly as recited in claim 11, wherein when the shroud is in the first position, the shroud does not interfere with a line of sight to terminal ends of the mounting tails along a direction that is perpendicular to the mounting direction.

17. A method of mounting an electrical connector assembly onto a substrate along a mounting direction, the electrical connector assembly including an electrical connector that includes a dielectric housing and a plurality of electrical contacts supported by the dielectric housing, the electrical connector assembly further including an electrically conductive shroud, the method comprising the steps of:

attaching the shroud to the connector housing in a first position relative to the connector housing, such that mounting tails of the electrical contacts terminate at a location that is spaced from an upper exterior surface of the connector housing a first distance along the mounting direction and at least one mounting member of the shroud terminates at a location that is spaced from the upper exterior surface of the connector housing a second distance along the mounting direction that is shorter than the first distance, wherein when in the first position, the shroud and the connector housing define a mechanical interference that resists movement of the shroud along the connector housing from the first position to a second position, the at least one mounting member received in a complementary aperture of the underlying substrate when the shroud is in the second position;

aligning the mounting tails along the mounting direction with complementary vias of the underlying substrate while the shroud is in the first position, such that the mounting tails are at least partially received in the complementary vias; and applying a force in the mounting direction to the shroud, such that the force overcomes the mechanical interference, thereby moving the shroud from the first position toward the second position, wherein the method further comprises the step of receiving a first alignment member, which includes at least one compressible crush rib, of the connector housing in a second alignment member of the shroud, thereby causing the at least one compressible crush rib of the first alignment member to mechanically interfere with the shroud when the shroud is in the first position so as to provide the mechanical interference when the shroud is in the first position.

18. The method as recited in claim 17, wherein applying the force further comprises:

applying the force in the mounting direction to the shroud until the shroud is in the second position, thereby moving the at least one mounting member toward the complementary aperture until the at least one mounting member is received by the complementary aperture.

19. The method as recited in claim 17, wherein the connector housing further includes at least one first alignment member and the shroud includes at least one second alignment member, wherein attaching the shroud to the connector housing in the first position further comprises:

placing the shroud over the connector housing so that the at least one first alignment member is at least partially received by the at least one second alignment member, wherein the at least one second alignment member mechanically interferes with the at least one first alignment to provide the mechanical interference when the shroud is in the first position.

20. An electrical connector assembly configured to be mounted onto an underlying substrate along a mounting direction, the electrical connector assembly comprising:

an electrical connector including a dielectric connector housing and at least one electrical contact carried by the connector housing, the at least one electrical contact including a mounting tail configured to be mounted to the underlying substrate and a mating end configured to be electrically mated to a complementary electrical component, the connector housing including at least one first alignment member and a housing body that defines an exterior surface, wherein the at least one first alignment member 1) projects out from the exterior surface, 2) has a thickness along a select direction, and 3) includes an alignment body and at least one compressible crush rib that projects out from the alignment body along the select direction; and an electrically conductive shroud configured to fit over the connector housing, the shroud including 1) at least one second alignment member having a thickness along the select direction, 2) a mounting member configured to be received in a complementary aperture of the underlying substrate, and 3) a shroud body that defines an interior surface that faces the exterior surface of the connector housing when the shroud is fit over the connector housing, the at least one second alignment member configured to receive the at least one first alignment member when the shroud is mounted onto the connector housing, wherein the at least second alignment member includes 1) a recess that is defined by the interior surface, and 2) one or more sides that define the recess, the recess bound by opposed sides of the second alignment member that are spaced from each other along the select direction, and wherein, when the shroud is mounted onto the connector housing so that the mounting member is aligned with the complementary aperture, one of the opposed sides of the second alignment member is configured to compress the crush rib as the shroud is fit over the connector housing so that thickness of the at least one first alignment member decreases to be no greater than the thickness of the at least one second alignment member.

21. The electrical connector assembly as recited in claim 20, wherein the mounting member projects out from the shroud body in the mounting direction.

22. The electrical connector assembly as recited in claim 21, wherein the at least one crush rib is elongate along the mounting direction from a first end proximate a first end of the at least one first alignment member toward an opposed second end proximate a second end of the at least one first alignment member, the first end of the at least one first alignment member disposed closer to the underlying substrate than the second end of the at least one first alignment member when the electrical connector is mounted onto the underlying substrate.

23. The electrical connector assembly as recited in claim 22, wherein the second end of the at least one first alignment member is tapered.

24. The electrical connector assembly as recited in claim 20, wherein the at least one first alignment member comprises a second compressible crush rib that projects out from the other of the opposed sides along the select direction, and the other of the opposed sides of the second alignment member is configured to compress the second crush rib as the shroud is fit over the connector housing.

* * * * *